US008827837B2

(12) United States Patent
Hayase et al.

(10) Patent No.: US 8,827,837 B2
(45) Date of Patent: Sep. 9, 2014

(54) GOLF CLUB HEAD

(75) Inventors: Seiji Hayase, Kobe (JP); Masahide Onuki, Kobe (JP)

(73) Assignee: SRI Sports Limited, Kobe (JP)

( * ) Notice: Subject to any disclaimer, the term of this patent is extended or adjusted under 35 U.S.C. 154(b) by 108 days.

(21) Appl. No.: 13/273,394

(22) Filed: Oct. 14, 2011

(65) Prior Publication Data

US 2012/0100930 A1 Apr. 26, 2012

(30) Foreign Application Priority Data

Oct. 22, 2010 (JP) ..... 2010-237327

(51) Int. Cl.
*A63B 53/04* (2006.01)
*A63B 59/00* (2006.01)

(52) U.S. Cl.
CPC ..... *A63B 53/0466* (2013.01); *A63B 2053/0412* (2013.01); *A63B 2209/023* (2013.01); *A63B 59/0092* (2013.01); *A63B 2209/00* (2013.01)
USPC ..... 473/345; 473/349

(58) Field of Classification Search
USPC ..... 473/345
See application file for complete search history.

(56) References Cited

U.S. PATENT DOCUMENTS

| | | | | |
|---|---|---|---|---|
| 6,354,963 | B1 | 3/2002 | Kodama et al. | |
| 2002/0042307 | A1 * | 4/2002 | Deshmukh | 473/335 |
| 2007/0178988 | A1 | 8/2007 | Tavares et al. | |

FOREIGN PATENT DOCUMENTS

| | | | |
|---|---|---|---|
| JP | 11-151330 | A | 6/1999 |
| JP | 11-290486 | A | 10/1999 |
| JP | 2002-35180 | A | 2/2002 |
| JP | 2003-135633 | A | 5/2003 |
| JP | 2005-34540 | A | 2/2005 |
| JP | 2009-525131 | A | 7/2009 |

OTHER PUBLICATIONS

"Production and Mechanical Property of Biomedical Porous Ti—Nb—Sn Alloy", The Japan Institute of Metal (Nihon-kinzoku gakkai), Annual autumn meeting (the 135th) outline, p. 466, 2004.

* cited by examiner

*Primary Examiner* — Michael Dennis
(74) *Attorney, Agent, or Firm* — Birch, Stewart, Kolasch & Birch, LLP

(57) ABSTRACT

A golf club head 2 includes a face 4, a crown 6, a sole 8, and a side 10. At least a part of the crown 6, at least a part of the sole 8, or at least a part of the side 10 is formed by a porous part Ps including a porous metal. Porosity on a surface side of the porous part Ps is smaller than porosity on an inner side of the porous part Ps. Preferably, the porous part Ps has skin layers Ls formed on both sides thereof and a core layer Lc formed therebetween. Porosity of the skin layer Ls is smaller than that of the core layer. Preferably, a thickness of the skin layer is 0.05 mm or greater and 0.2 mm or less. Preferably, the whole porous part Ps is integrally formed.

11 Claims, 8 Drawing Sheets

GOLF CLUB HEAD

The present application claims priority on Patent Application No. 2010-237327 filed in JAPAN on Oct. 22, 2010, the entire contents of which are hereby incorporated by reference.

BACKGROUND OF THE INVENTION

1. Field of the Invention

The present invention relates to a golf club head.

2. Description of the Related Art

Regarding a material used for a golf club head, various proposals have been made. Japanese Patent Application Laid-Open No. 2002-35180 discloses a golf club head using a porous metal. As described in Paragraph [0021] of Japanese Patent Application Laid-Open No. 2002-35180, a position of a center of gravity can be optionally set by making at least a part of a face and/or at least a part of a crown of a porous metal, and appropriately setting a void ratio thereof.

Japanese Patent Application Laid-Open No. 11-151330 discloses a club head for golf having a head hitting part having a porous structure in order to enhance a hitting feel and a hitting sound. In the invention, a surface density on a face surface side of the head hitting part is precise, and an internal density on a back surface side thereof is coarse.

Japanese Patent Application Laid-Open No. 2003-135633 discloses a golf club head in which at least any one of a head body and a face member is made of a porous metal having porosity of 5 to 50%. A manufacturing method for subjecting a raw material metal having porosity of 10 to 90% to plastic forming to produce a porous metal having porosity of 5 to 50% is described in claim 8 of the document. In FIG. 7, a constitution in which metal plates are joined to both sides of a porous face member is disclosed.

A view showing the relationship between porosity and an elastic modulus of a porous metal made of a titanium alloy is described in The Japan Institute of Metal (Nihon-Kinzoku gakkai), Annual autumn meeting (the 135th) outline (2004), p. 466.

SUMMARY OF THE INVENTION

Generally, the porous metal has a low elastic modulus. When the porous metal is used for the head, rigidity is reduced as compared with the case where an ordinary metal is used. When a thickness is increased in order not to reduce the rigidity, weight saving is not achieved, which loses the meaning for use of the porous metal.

A head using carbon fiber reinforced plastic (CFRP) is known as other weight saving technique. An example of the head is a head obtained by combining a Ti alloy with carbon fiber reinforced plastic (CFRP). Although a degree of freedom of designing such as designing of a center of gravity can be improved in the head, the head has problems such as deterioration of a hitting sound and increase of manufacture cost.

It is an object of the present invention to provide a golf club head having a high degree of freedom of designing using a member capable of suppressing reduction of rigidity and of achieving weight saving.

A golf club head of the present invention includes a face, a crown, a sole, and a side. In the head, at least a part of the crown, at least a part of the sole, or at least a part of the side is formed by a porous part including a porous metal. Porosity on a surface side of the porous part is smaller than that on an inner side of the porous part. The surface side of the porous part is obverce and reverse sides of the porous part.

Preferably, the porous part has skin layers formed on both sides thereof and a core layer formed between the skin layers. Porosity of the skin layer is smaller than that of the core layer.

Preferably, a thickness of the skin layer is 0.05 mm or greater and 0.2 mm or less.

Preferably, the whole porous part is integrally formed.

Preferably, the porous part forms at least a part of the crown or at least a part of the side.

Preferably, a head volume is equal to or greater than 100 cc; a head weight is equal to or less than 250 g; and a lateral moment of inertia of the head is equal to or greater than 2000 $g \cdot cm^2$. More preferably, a head volume is equal to or greater than 400 cc; a head weight is equal to or less than 200 g; and a lateral moment of inertia of the head is equal to or greater than 5000 $g \cdot cm^2$.

DESCRIPTION OF THE PREFERRED EMBODIMENTS

Hereinafter, the present invention will be described in detail based on preferred embodiments with appropriate references to the drawings.

Figure 1:
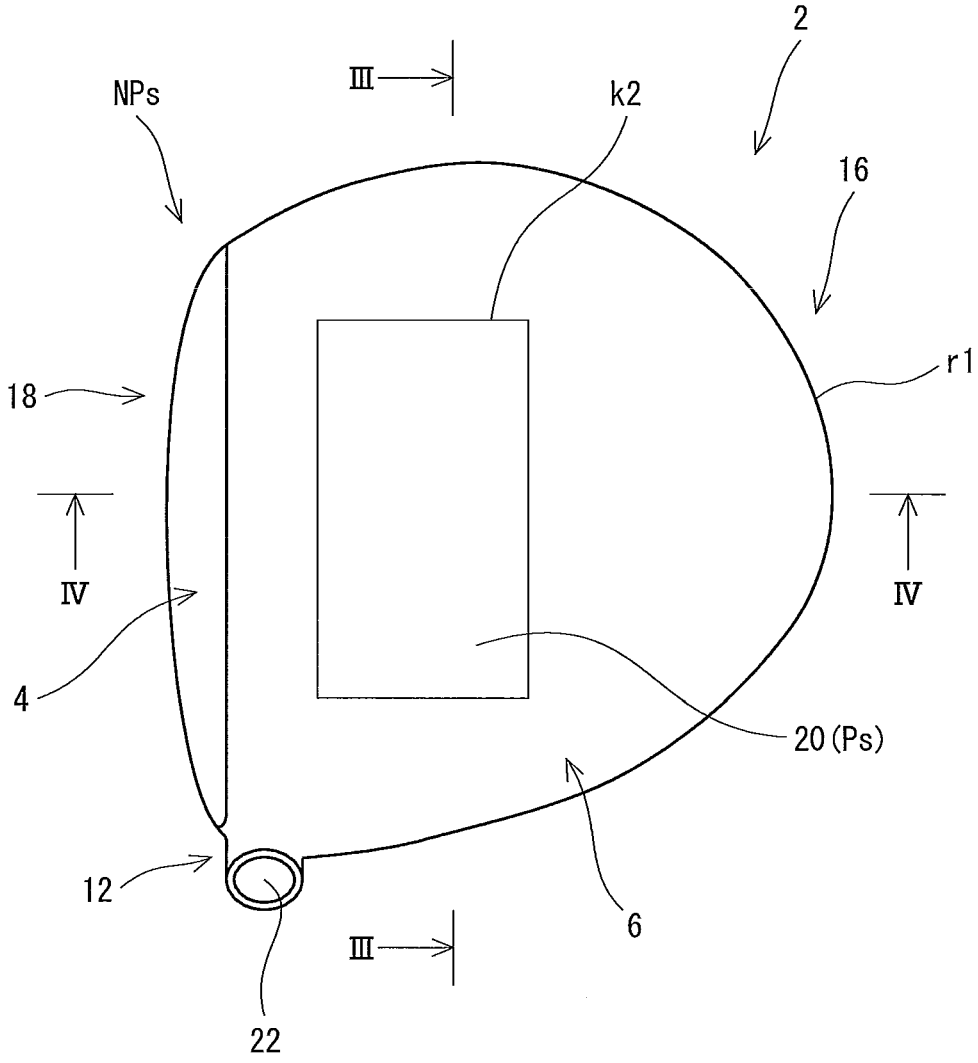
FIG. 1 is a plan view of a golf club head according to an embodiment of the present invention.
Figure 2:
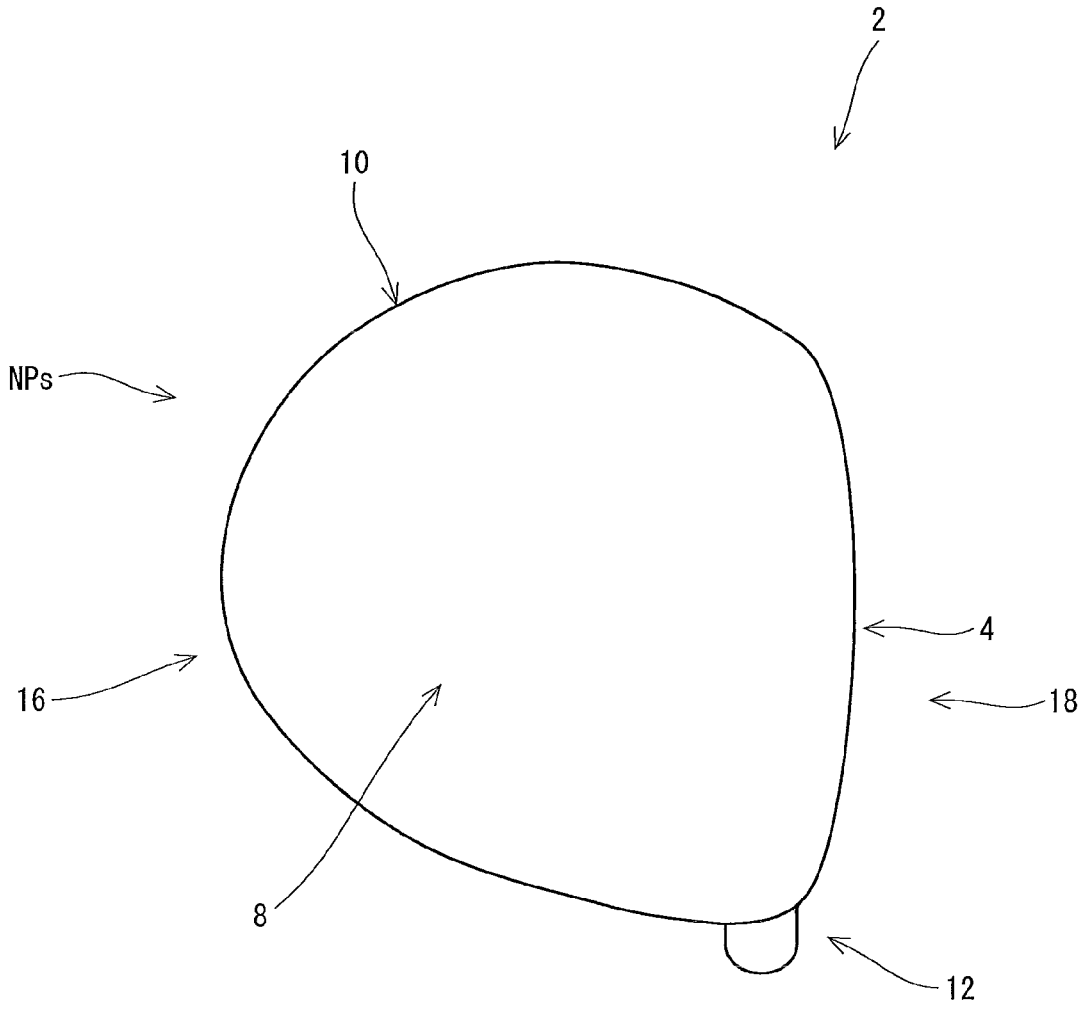
FIG. 2 is a bottom view of the head of FIG. 1.
Figure 3:
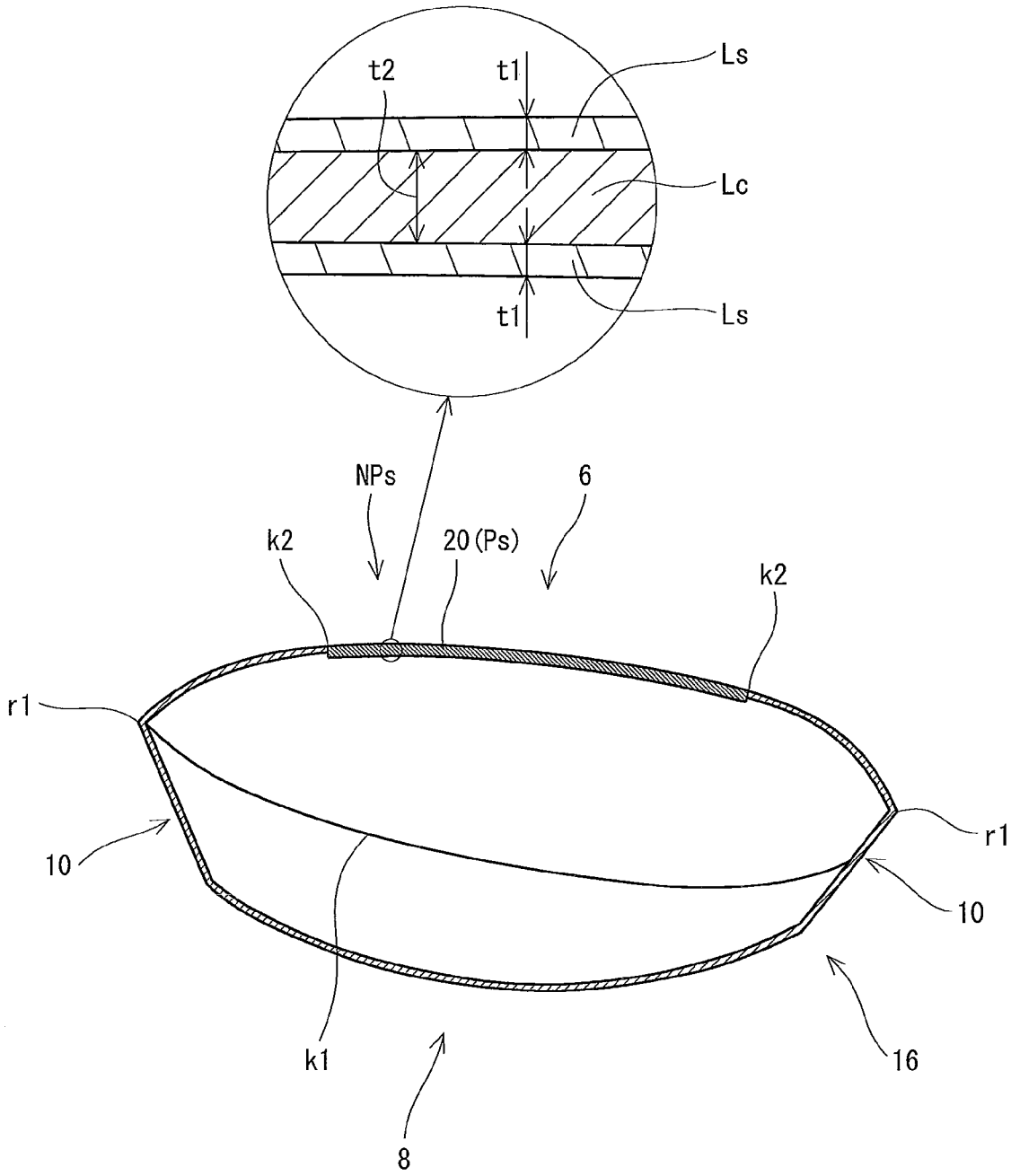
FIG. 3 is a cross sectional view taken along line of FIG. 1.
Figure 4:
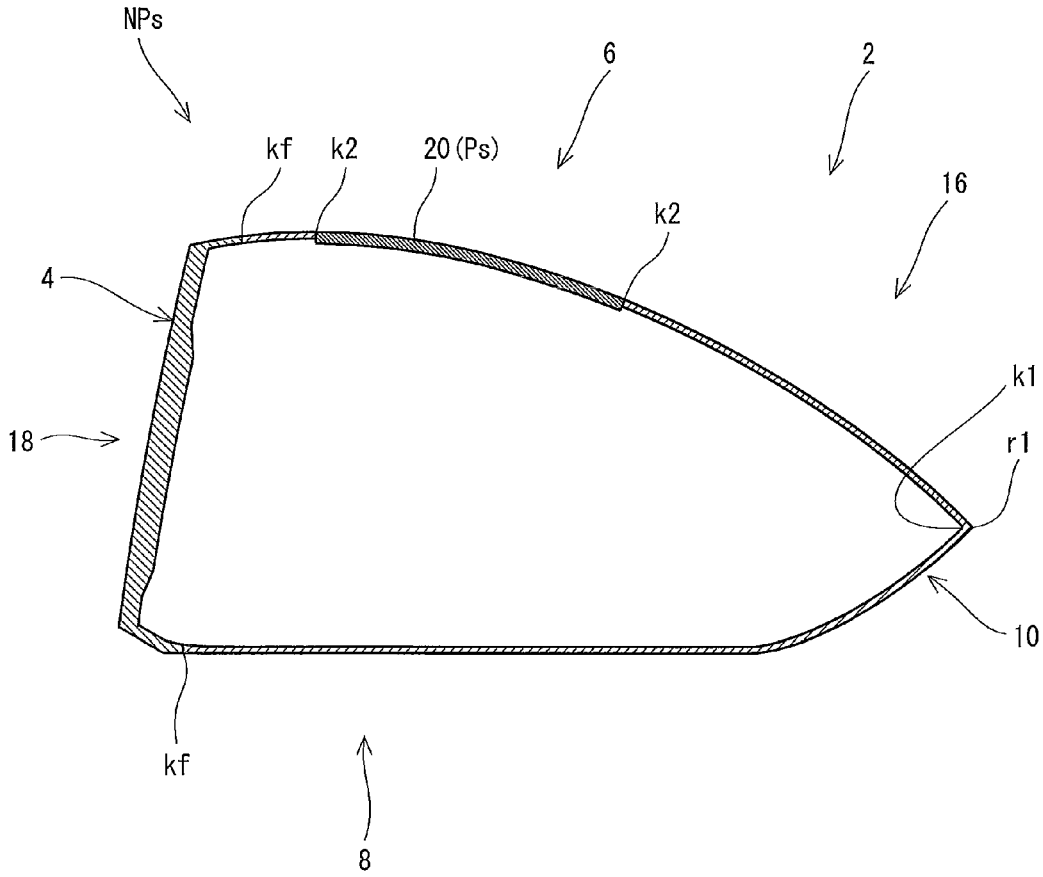
FIG. 4 is a cross sectional view taken along line IV-IV of FIG. 1.

As shown in FIGS. 1 to 4, a head 2 has a face 4, a crown 6, a sole 8, a side 10, and a hosel 12. The crown 6 extends toward a back of the head from an upper edge of the face 4. The sole 8 extends toward the back of the head from a lower edge of the face 4. The side 10 extends between the crown 6 and the sole 8. As shown in FIGS. 3 and 4, the inside of the head 2 is hollow. The head 2 is a hollow head. The head 2 is a so-called wood type golf club head.

As shown in FIGS. 3 and 4, a boundary k1 between the side 10 and the crown 6 exists. The boundary k1 includes a profile line r1 (described later).

Depending on a shape of the head, a boundary between the side 10 and the sole 8 may be unclear. For example, when a surface between the sole 8 and the crown 6 is smoothly continued, the boundary is unclear. In this case, the boundary between the sole 8 and the side 10 is defined as follows. A position separated by 15 mm from the profile line r1 of the head 2 when viewed from upside of the crown is regarded as the boundary between the sole 8 and the side 10.

The head 2 is obtained by joining a plurality of members including a porous member 20. Specifically, the head 2 is obtained by joining a head body 16, a face member 18, and a porous member 20 (see FIG. 4). A joining method is welding. The porous member 20 and a member (head body 16) adjacent thereto Can be welded. All of the head body 16, the face member 18, and the porous member 20 are made of a titanium alloy. A boundary k2 between the porous member 20 and the head body 16 is shown in FIG. 2 or the like. A boundary kf between the head body 16 and the face member 18 is shown in FIG. 4.

As described above, the porous member 20 and the member (head body 16) adjacent to the porous member 20 are welded. Joining strength between the porous member 20 and the head body 16 is high. The welded porous member 20 effectively functions as a structure of the head 2.

As described above, the porous member 20 is fixed by welding. No overlapping portion exists between the porous part Ps and the head body. In the head 2, no overlapping portion for fixing the porous member 20 exists. This point is different from the case where a CFRP member is used. No overlapping portion contributes to weight saving. No overlapping portion improves a degree of freedom of designing of the head.

The face member 18 constitutes the whole face 4. Furthermore, the face member 18 constitutes a part of the crown 6, a part of the sole 8, and a part of the side 10. The face member 18 is approximately dish-shaped (cup-shaped). The face member 18 may be referred to as a cup face.

The head body 16 constitutes a part of the crown 6, a part of the sole 8, a part of the side 10, and the whole hosel 12. The body 16 has a through hole having a shape corresponding to that of the porous member 20. The through hole is located in the crown 6. The porous member 20 is disposed in the through hole.

The porous member 20 includes a porous metal. The whole porous member 20 is integrally formed. The whole porous member 20 may be the porous metal.

As shown in FIG. 1, the hosel 12 has a hole 22 to which a shaft is mounted. The shaft (not shown) is inserted into the hole 22.

In the present invention, a structure of the head and a method for manufacturing the head are not restricted.

The porous part Ps includes a porous metal. The porous metal exists in at least a part of a thickness direction of the porous part Ps. It is preferable that the whole porous part Ps is integrally formed. In the embodiment, a portion formed by the porous member 20 is the porous part Ps. The porous part Ps may be integrally formed with a portion other than the porous part Ps (crown or the like).

The portion other than the porous part Ps is also referred to as a non-porous part NPs. In the embodiment, the head body 16 and the face member 18 are the non-porous parts NPs.

The porous part Ps is located in the crown 6. The whole porous part Ps is located in the crown 6. The porous part Ps does not exist in a portion other than the crown 6. In the embodiment, the whole porous part Ps is located in the crown 6. The porous part Ps disposed in the crown 6 can lower a position of a center of gravity the head. The low position of a center of gravity contributes to a high launch angle and a small backspin amount. The low position of a center of gravity contributes to increase of a flight distance.

In the embodiment, a part of the crown 6 is the porous part Ps. The whole crown 6 may be the porous part Ps.

As shown in FIGS. 3 and 4, the porous part Ps occupies the whole thickness of the head 2. In the present application, the porous part Ps occupying the whole thickness of the head 2 is also referred to as a whole thickness part. In the embodiment, the whole porous part Ps is the whole thickness part. A part of the porous part Ps may be the whole thickness part.

An outer surface of the whole thickness part is exposed to the outside of the head 2. An inner surface of the whole thickness part is exposed to a hollow part of the head 2.

The outer surface of the porous part Ps constitutes a part of an outer surface of the crown. The outer surface of the porous part Ps and an outer surface of the non-porous part NPs are smoothly continued.

An inner surface of the porous part Ps is a smoothly continued curved surface.

As shown in FIGS. 3 and 4, a thickness of the porous part Ps is greater than that of a portion adjacent to the porous part Ps. The thickness of the porous part Ps is constant. The thickness of the porous part Ps may be varied.

[Structure of Porous Part Ps]

Porosity on a surface side of the porous part Ps is smaller than that on an inner side of the porous part Ps. The structure enables coexistence of both rigidity and lightweight properties, which will be described later.

A variation in the porosity in the thickness direction of the porous part Ps may be continuous or discontinuous. More preferably, the porous part Ps has a skin layer Ls and a core layer Lc, which will be described later.

A view obtained by enlarging a section of the porous part Ps is shown in FIG. 3 (see the inside of a circle of FIG. 3). The porous part Ps has the skin layers Ls formed on both sides thereof, and the core layer Lc formed between the skin layers Ls. In the embodiment, the porous part Ps is a three-layer structure. The core layer Lc may be formed by a plurality of layers. In a thickness direction of the skin layer Ls, porosity may be continuously varied. In a thickness direction of the core layer Lc, porosity may be continuously varied.

When the porosity is varied in the skin layer Ls and the core layer Lc, the aspect of the variation thereof is not restricted. Average porosity of the skin layer Ls needs to be smaller than that of the core layer Lc.

When the whole porous part Ps is integrally formed, the skin layer Ls is firmly joined to the core layer Lc. The firm joining can enhance flexural rigidity and strength of the porous part Ps.

The outermost layer is the skin layer Ls. The inner side skin layer Ls constitutes an inner surface of the head. The outer side skin layer Ls constitutes an outer surface of the head.

Porosity of the skin layer Ls is smaller than that of the core layer Lc. The skin layer Ls having smaller porosity improves rigidity of the porous part Ps. The core layer Lc having greater porosity contributes to reduction of a weight (apparent specific gravity) of the porous part Ps. The core layer Lc having greater porosity can suppress the weight of the porous part Ps, and can increase the thickness of the porous part Ps. The increase of the thickness can enhance the rigidity of the porous part Ps. The porous part Ps using the skin layers Ls and the core layer Lc together can achieve high rigidity and lightweight properties.

The skin layers Ls located on both sides (obverse side and reverse side) of the core layer Lc suppresses the weight of the porous part Ps and effectively enhances the flexural rigidity of the porous part Ps.

The high rigidity and the lightweight properties enhance the degree of freedom of designing of the head. Retention of the rigidity, and the weight saving can be achieved by use of the porous part Ps. When a weight of a part of the head is reduced, the position of a center of gravity of the head can be easily varied. The porous part Ps can enhance the degree of freedom of designing of the position of a center of gravity of the head. The optimized position of a center of gravity of the head enables a great flight distance.

The porous part Ps suppressing the reduction of the rigidity contributes to increase of a natural frequency. The porous part Ps contributes to a high-pitch hitting sound. The high-pitch hitting sound tends to be preferred by golf players. A known CFRP member has high vibration damping property. Therefore, a hitting sound which is high, clear, and reverberates for a long time is hardly obtained by use of the CFRP member. The use of the porous part Ps can achieve a good hitting sound as compared with use of the CFRP member.

Since the skin layer Ls forming the outer surface of the head has small porosity, the pores are inconspicuous. Therefore, the appearance of the head can be improved. Since the skin layer Ls has small porosity, the skin layer Ls can be easily coated. Furthermore, the skin layer Ls forming the outer surface of the head suppresses the penetration of soil or a lawn or the like into the pores.

[Position of Porous Part Ps]

The porous part Ps forms at least a part of the crown 6, at least a part of the sole 8, or at least a part of the side 10. In respect of lowering the position of a center of gravity of the head, the porous part Ps preferably forms at least a part of the crown 6 or at least a part of the side 10, and more preferably forms at least a part of the crown 6.

The porous part Ps disposed in the crown 6 can lower the position of a center of gravity of the head. In this respect, a ratio Rc of an area of the porous part Ps in a crown area is preferably equal to or greater than 15%, more preferably equal to or greater than 20%, still more preferably equal to or greater than 30%, and yet still more preferably equal to or greater than 40%. The ratio Rc may be 100%.

Figure 5:
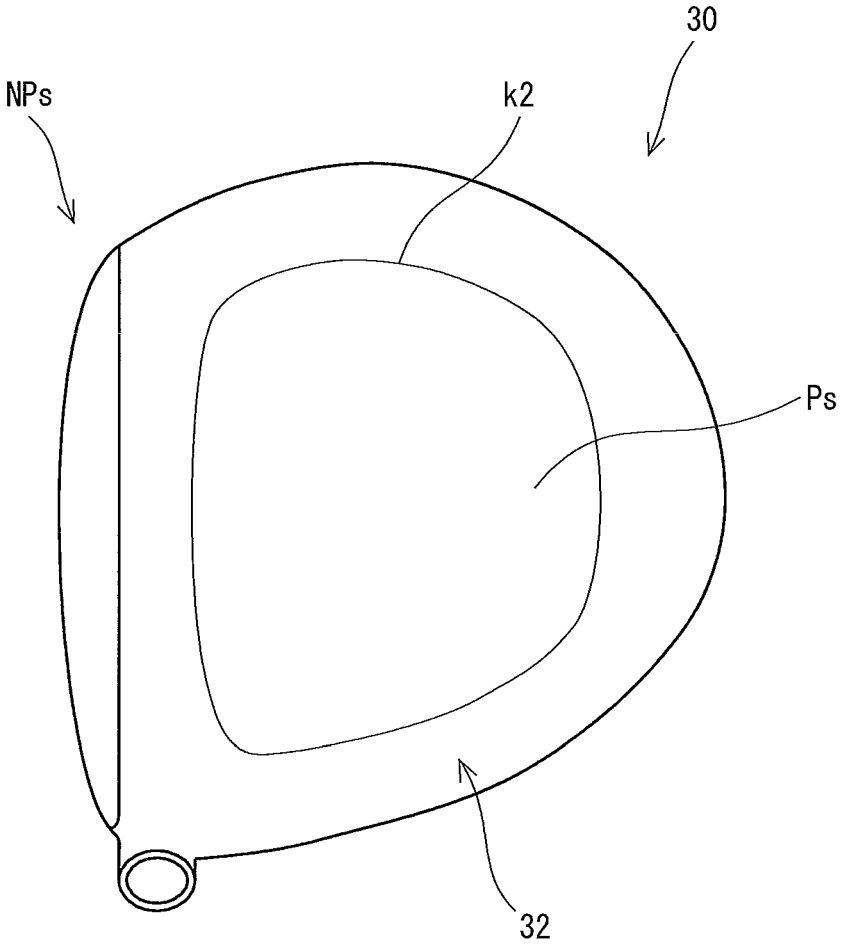
FIG. 5 is a plan view of a golf club head according to another embodiment.

FIG. 5 is a view of a head 30 according to a second embodiment, as viewed from a crown side. A porous part Ps is disposed in a crown 32 of the head 30. The ratio Rc in the head 30 is great as compared with the head 2 of the first embodiment.

[Porosity of Porous Part Ps]

The porosity of the skin layer Ls is not restricted. In respect of enhancing the rigidity of the porous part Ps, the porosity of the skin layer Ls is preferably equal to or less than 5% (0.05), more preferably equal to or less than 1% (0.01), and still more preferably equal to or less than 0.5% (0.005). The porosity of the skin layer Ls may be 0%. The porosity in the present application is % by volume (volume ratio).

Porosity of the core layer Lc is not restricted. The rigidity of the porous part Ps can be increased while the weight of the porous part Ps can be suppressed by lowering the apparent specific gravity of the porous part Ps. In this respect, the porosity of the core layer Lc is preferably equal to or greater than 25% (0.25), and more preferably equal to or greater than 30% (0.30). In respects of the rigidity and of the strength, the porosity of the core layer Lc is preferably equal to or less than 80% (0.80), more preferably equal to or less than 70% (0.70), still more preferably equal to or less than 60% (0.60), and particularly preferably equal to or less than 50% (0.50).

[Material]

A material of the porous part Ps is not restricted as long as the material is a metal. Examples of the material of the porous part Ps include a titanium alloy, an aluminium alloy, a magnesium alloy, stainless steel, and maraging steel. In respect of fully utilizing the high rigidity of the porous part Ps, the porous part Ps is preferably welded to a portion adjacent to the porous part Ps. In this respect, the material of the porous part Ps is preferably a material capable of being welded to the adjacent portion. When the adjacent portion is made of a titanium alloy, the porous part Ps is also preferably made of the titanium alloy in point of weld strength.

A material of the non-porous part NPs is not restricted. Examples of the material of the non-porous part NPs include a metal and carbon fiber reinforced plastic (CFRP). Examples of the metal used for the non-porous part NPs include one or more kinds of metals selected from pure titanium, a titanium alloy, stainless steel, maraging steel, an aluminium alloy, a magnesium alloy, and a tungsten-nickel alloy. Examples of the stainless steel include SUS630 and SUS304. Examples of the titanium alloy include 6-4 titanium (Ti-6A1-4V) and Ti-15V-3Cr-3Sn-3A1.

An overlapping portion for joining a metal member to a CFRP member is required for a conventional combined head obtained by combining the metal member with the CFRP member. In the overlapping portion, bonding is ordinarily performed. Since the CFRP member is used in the conventional combined head, the conventional combined head has great vibration damping, and is apt to deteriorate a hitting sound. When an adhesive is used to join the CFRP member, the adhesive can also promote the vibration damping. Use of the adhesive is apt to deteriorate the hitting sound. On the other hand, since the porous part Ps is a metal, the hitting sound is good. When the porous part Ps is welded, the overlapping portion for joining the porous part Ps can be unrequired or reduced. No overlapping portion contributes to weight saving. No adhesives can contribute to improvement of the hitting sound.

[Thickness]

A thickness t1 of the skin layer Ls is not restricted. In respect of lowering the apparent specific gravity of the porous part Ps, the thickness t1 of the skin layer Ls is preferably thinner than a thickness t2 of the core layer Lc. In respect of lowering the apparent specific gravity of the porous part Ps, the thickness t1 is preferably equal to or less than 0.2 mm, and more preferably equal to or less than 0.15 mm. In respect of enhancing the rigidity of the porous part Ps, the thickness t1 is preferably equal to or greater than 0.05 mm, and more preferably equal to or greater than 0.1 mm.

The thickness t2 of the core layer Lc is not restricted. In respects of lowering the apparent specific gravity of the porous part Ps and of enhancing the rigidity of the porous part Ps, the thickness t2 is preferably equal to or greater than 0.2 mm, more preferably equal to or greater than 0.3 mm, and still more preferably equal to or greater than 0.4 mm. An upper limit value of the thickness t2 is suitably set by a setting weight of the porous part Ps. For example, the thickness t2 can be set to be equal to or less than 1.0 mm, further equal to or less than 0.8 mm, and still further equal to or less than 0.6 mm.

A ratio (also referred to as a skin layer ratio in the present application) of the thickness of the skin layer Ls to the whole thickness of the porous part Ps is not restricted.

In respect of enhancing the rigidity of the porous part Ps, the skin layer ratio is preferably equal to or greater than 8%, more preferably equal to or greater than 10%, still more preferably equal to or greater than 20%, and yet still more preferably equal to or greater than 30%. In respects of reducing the weight of the porous part Ps and enhancing the rigidity of the porous part Ps, the skin layer ratio is preferably equal to or less than 80%, more preferably equal to or less than 70%, still more preferably equal to or less than 60%, and yet still more preferably equal to or less than 50%.

[Manufacturing Process]

A manufacturing method of the porous member is not restricted, and as the manufacturing method, a known method can be employed. Examples of the manufacturing method include a metal powder injection molding (MIM) method, a method for compression-molding metal powder, a method for sintering and molding metal powder, and a method for injecting gas into a melted metal.

The metal powder injection molding method includes the steps of: mixing a binder containing a resin and/or a wax with metal powder to obtain a mixture; injection-molding the mixture into a mold; degreasing the binder; and sintering the injection-molded body after the degreasing step.

The porous metal capable of being molded by these manufacturing methods has a large number of small pores. A size of the pore is ordinarily about 10 nm or greater and about 1 mm or less. In respects of rigidity and of strength, the size of the pore is preferably equal to or less than 100 μm. A ratio of a volume of the pores to the volume of the whole porous metal is porosity.

A manufacturing method of the porous member having the skin layer Ls and the core layer Lc is not restricted. Examples of the manufacturing method include a method for separately forming a material for the skin layer Ls and a material for the core layer Lc, and integrally forming the materials in the last forming step, to obtain the porous member.

Examples of the method for integrally forming the skin layers Ls (two layers) with the core layer Lc include the following manufacturing method. That is, the method forms a mixture obtained by adding resin particles for forming pores to a MIM raw material containing metal powder and a binder, and subjects the formed body to degreasing and sintering steps to manufacture metal porous parts. The method is known as a powder space holder MIM (PSH-MIM) method.

A manufacturing method of the head is not restricted. Ordinarily, a hollow head is manufactured by joining two or more members. A preferable head is manufactured by joining two or more members including the porous member. A manufacturing method of each of the members is not restricted. Examples of the method include casting, forging, and press forming.

A volume of the head is not restricted. When the volume of the head is great, the effects (rigidity and weight saving) of the porous part Ps can stand out. In this respect, the volume of the head is preferably equal to or greater than 100 cc, more preferably equal to or greater than 150 cc, and still more preferably equal to or greater than 200 cc. When the effect of the hitting sound is also considered, the volume of the head is preferably greater. In this respect, the volume of the head is preferably equal to or greater than 400 cc, more preferably equal to or greater than 420 cc, and still more preferably equal to or greater than 440 cc. In respect of observing the rules for the golf club, the volume of the head is preferably equal to or less than 470 cc, and particularly preferably 460 cc±10 cc when the error of measurement of 10 cc is considered.

A weight of the head is not restricted. The effects (rigidity and weight saving) of the porous part Ps stand out when the volume of the head is great and the weight of the head is small. Specifically, effectivity is high in the wood type head, the utility type head, and the hybrid type head. In this respect, the weight of the head is preferably equal to or less than 250 g, more preferably equal to or less than 220 g, and still more preferably equal to or less than 200 g.

In the case of a head having a thin portion in which the porous part Ps is provided, the porous part Ps is particularly effective. That is, the porous part Ps can suppress the reduction of the rigidity when the porous part Ps is made thin. In this respect, an average thickness of the crown is preferably equal to or less than 1 mm, more preferably equal to or less than 0.8 mm, and still more preferably equal to or less than 0.7 mm. In respect of the strength of the head, the average thickness of the crown is preferably equal to or greater than 0.5 mm.

In the case of the head having the thin portion in which the porous part Ps is provided, the porous part Ps is particularly effective. That is, the porous part Ps can suppress the reduction of the rigidity when the porous part Ps is made thin. In this respect, an average thickness of the side is preferably equal to or less than 1 mm, more preferably equal to or less than 0.8 mm, and still more preferably equal to or less than 0.7 mm. In respect of the strength of the head, the average thickness of the side is preferably equal to or greater than 0.5 mm.

A lateral moment of inertia of the head is not restricted. As described above, the porous part Ps can contribute to the weight saving. A degree of freedom of weight distribution can be improved by use of the porous part Ps, and increase of the moment of inertia can be achieved. In this respect, the lateral moment of inertia of the head is preferably equal to or greater than 2000 g·cm$^2$, more preferably equal to or greater than 3000 g·cm$^2$, still more preferably equal to or greater than 4000 g·cm$^2$, and yet still more preferably equal to or greater than 5000 g·cm$^2$.

The lateral moment of inertia is a moment of inertia around an axis Z passing a center g of gravity of the head. The axis Z is an axis perpendicular to the level surface h in the head of the base condition. The lateral moment of inertia can be measured using MOMENT OF INERTIA MEASURING INSTRUMENT MODEL NO. 005-002 manufactured by INERTIA DYNAMICS INC.

EXAMPLES

Hereinafter, the effects of the present invention will be clarified by examples. However, the present invention should not be interpreted in a limited way based on the description of the examples.

Effects of a skin layer and a core layer were confirmed using a simulation. Effects of a thickness t1 of the skin layer and porosity of the core layer on a weight were confirmed under a condition where rigidity was constant.

In the simulation, a base body A was first considered. The base body A has no pore. A thickness of the base body A is T; a density is ρ; and an elastic modulus is E. Since the base body A has no pore, distinction of the core layer and the skin layer does not exist. That is, in the base body A, the thickness t1 of the skin layer is 0 mm. The thickness T was set to 0.7 mm. The density ρ was set to 4420 kg/m$^3$. E was set to 126 GPa.

Next, a large number of test bodies B were considered. A material of each of the test bodies B were made the same as that of the base body A. Each of the test bodies B has a three-layer structure, and has the core layer and the skin layer. The core layer has pores. The skin layer has no pore. A density and an elastic modulus of the skin layer are the same as those of the base body A.

Figure 6:
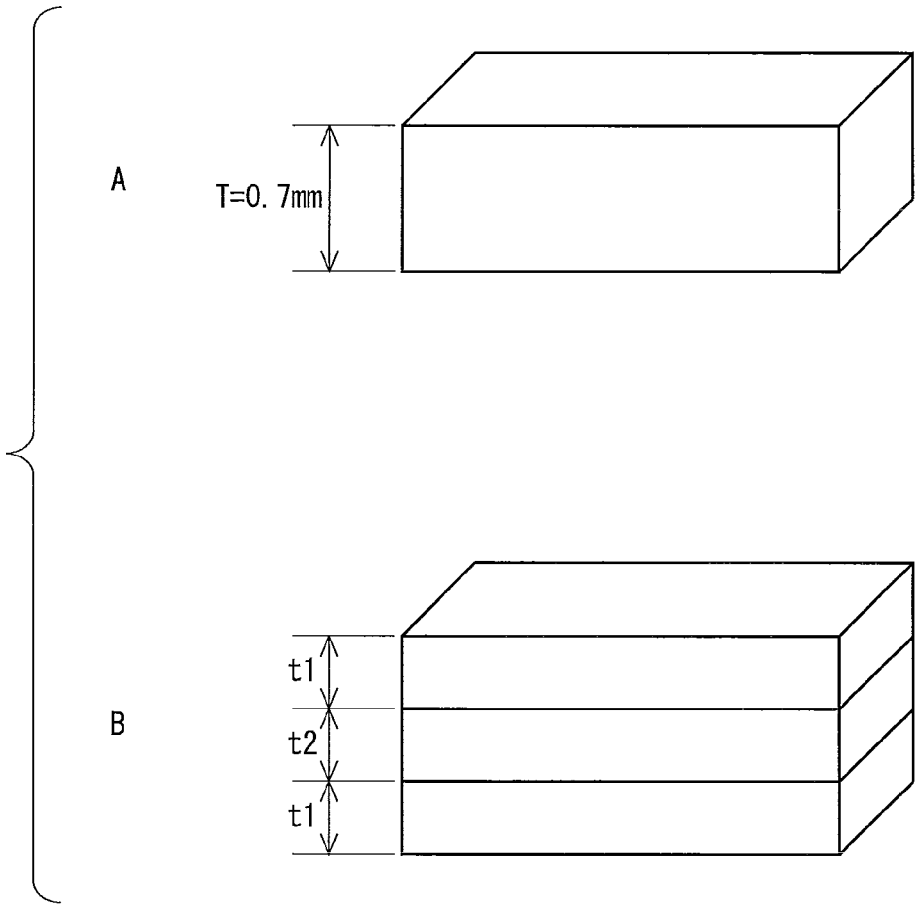
FIG. 6 is a perspective view showing a base body and a test body.

FIG. 6 is a perspective view showing the base body A and the test body B. The base body A and the test body B are rectangular parallelepipeds.

A thickness h of the test body B is represented by the following formula using the thickness t1 of the skin layer and a thickness t2 of the core layer.

$$h=t1+t1+t2$$

Bending rigidity EIb of the test body B is represented by the following formula considering a section second moment in a rectangular section.

$$EIb=W\times\{(Ep-E)\times t2^3+E\times h^3\}/12$$

Wherein W is a width of the rectangular section; and Ep is an elastic modulus of the core layer.

The relationship between the elastic modulus E and the elastic modulus Ep is represented by the following formula. ρp is a density of the core layer.

$$Ep=Ex(\rho p/\rho)^{\alpha}$$

α was set to 2.79 by referring to Figure described in the above-mentioned The Japan Institute of Metal (Nihon-Kinzoku gakkai), Annual autumn meeting (the 135th) outline (2004), p. 466. α was determined so that an elastic modulus ratio [(Ep/E)×100] was 30% when the porosity was 0.35.

Figure 7:
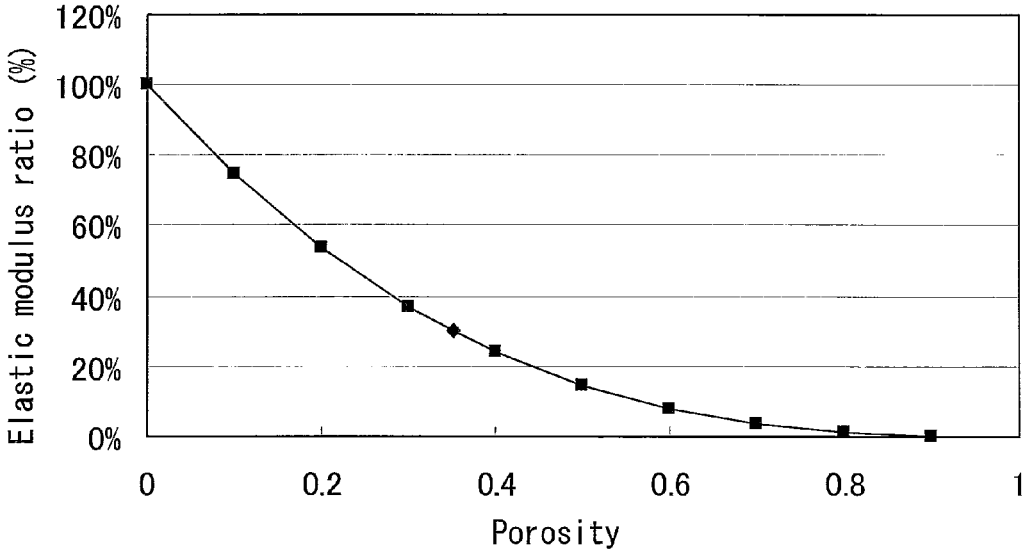
FIG. 7 is graph showing the relationship between porosity and an elastic modulus ratio.

The relationship between the porosity and the elastic modulus ratio (Ep/E) is as shown in a graph of FIG. 7 based on above mentioned conditions.

A condition where the flexural rigidities of all the test bodies B were the same as the flexural rigidity of the base body A was set. Under the condition, the thickness t2 of the core layer was calculated by varying the thickness t1 of the skin layer in the test body B and the porosity of the core layer in the test bodies B. Furthermore, a weight ratio of the test body B to the test body A was calculated based on the calculated thickness t2. The calculated weight ratio is shown in the following table 1.

Skin layer ratios of test bodies are shown in the following table 2.

TABLE 1

Weight ratios when thickness t1 of skin layer and porosity are varied (when rigidity is constant)

| | Thickness of skin layer (mm) | | | | | | | |
|---|---|---|---|---|---|---|---|---|
| Porosity | t1 = 0 | t1 = 0.05 | t1 = 0.1 | t1 = 0.15 | t1 = 0.2 | t1 = 0.25 | t1 = 0.3 | t1 = 0.35 |
| 0 | 100% | 100% | 100% | 100% | 100% | 100% | 100% | 100% |
| 0.1 | 99% | 97% | 96% | 96% | 96% | 97% | 99% | 100% |
| 0.2 | 98% | 93% | 91% | 91% | 92% | 95% | 97% | 100% |
| 0.3 | 98% | 89% | 86% | 86% | 88% | 92% | 96% | 100% |
| 0.35 | 97% | 86% | 83% | 84% | 86% | 90% | 95% | 100% |
| 0.4 | 97% | 83% | 80% | 81% | 84% | 89% | 94% | 100% |
| 0.5 | 95% | 76% | 73% | 75% | 80% | 86% | 93% | 100% |

TABLE 2

Skin layer ratios when thickness t1 of skin layer and porosity are varied (when rigidity is constant)

| | Thickness of skin layer (mm) | | | | | | | |
|---|---|---|---|---|---|---|---|---|
| Porosity | t1 = 0 | t1 = 0.05 | t1 = 0.1 | t1 = 0.15 | t1 = 0.2 | t1 = 0.25 | t1 = 0.3 | t1 = 0.35 |
| 0 | 0.0% | 14.3% | 28.6% | 42.9% | 57.1% | 71.4% | 85.7% | 100.0% |
| 0.1 | 0.0% | 13.5% | 27.6% | 42.1% | 56.7% | 71.3% | 85.7% | 100.0% |
| 0.2 | 0.0% | 12.6% | 26.7% | 41.5% | 56.4% | 71.2% | 85.7% | 100.0% |
| 0.3 | 0.0% | 11.8% | 25.9% | 40.9% | 56.1% | 71.1% | 85.7% | 100.0% |
| 0.35 | 0.0% | 11.4% | 25.5% | 40.7% | 56.0% | 71.0% | 85.7% | 100.0% |
| 0.4 | 0.0% | 11.1% | 25.1% | 40.4% | 55.9% | 71.0% | 85.7% | 100.0% |
| 0.5 | 0.0% | 10.4% | 24.5% | 40.0% | 55.7% | 70.9% | 85.6% | 100.0% |

Figure 8:
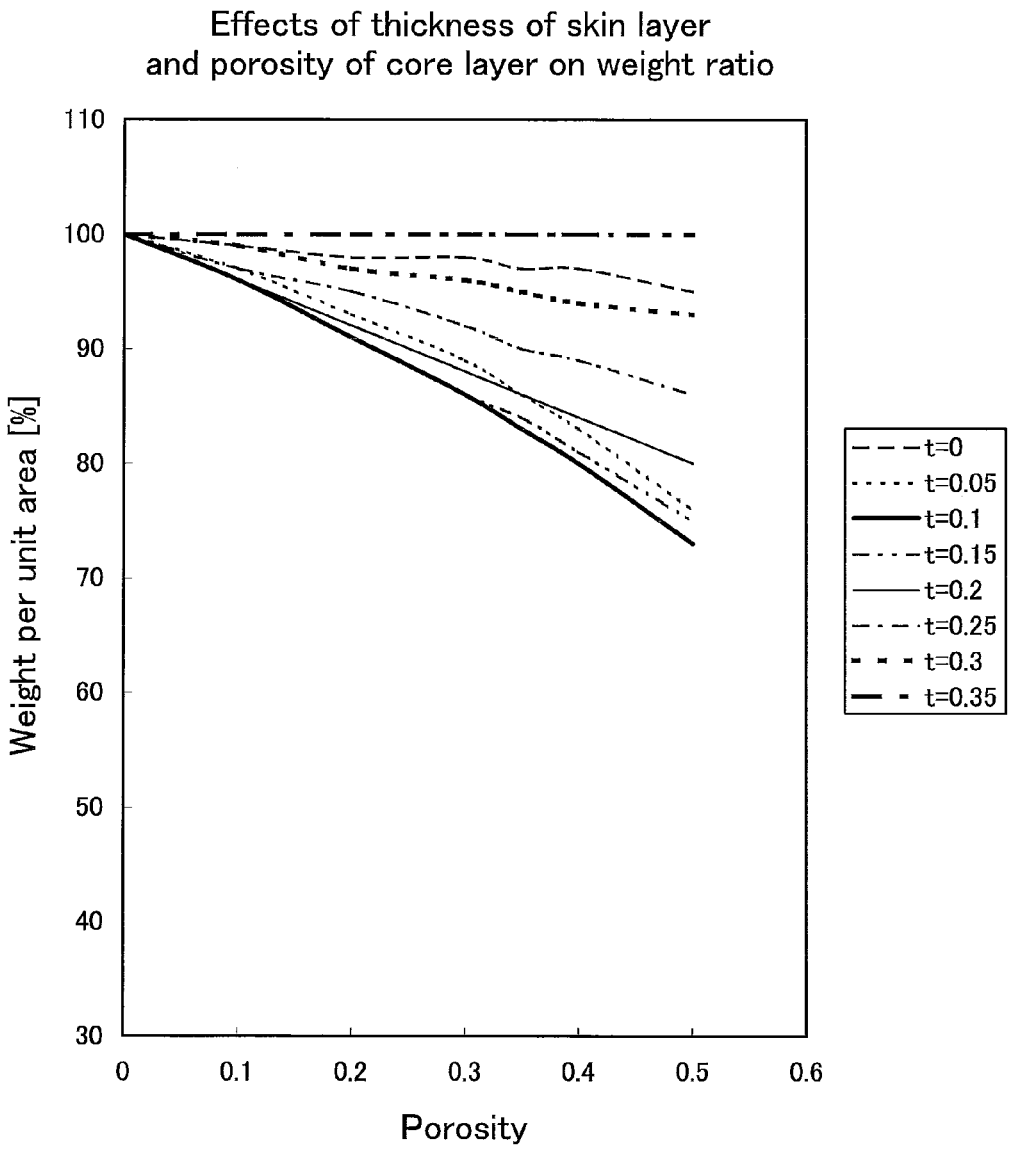
FIG. 8 is a graph based on data of Table 1.

FIG. 8 graphically displays the results of Table 1.

As the results of Table 1 show, the weight ratios of all the test bodies B were less than 100% under a condition where the flexural rigidity was constant. That is, the rigidities of all the test bodies B were retained and the weights thereof were reduced as compared with the base body A.

The results of Table 1 show that a numerical value range suitable for the thickness t1 of the skin layer exists. Table 1 shows that the effect of the weight saving is comparatively great when the thickness t1 of the skin layer is 0.05 mm or greater and 0.2 mm or less.

A preferable skin layer ratio (%) in the examples can be understood from Tables 1 and 2. That is, the skin layer ratio when the weight ratio in Table 1 is small is preferable. In this respect, the skin layer ratio (%) is preferably 5% or greater and 80% or less. When the porosity of the core layer is 30% or greater and 50% or less and the skin layer ratio (%) is 10% or greater and 72% or less, the weight ratio (Table 1) is equal to or less than 92%, and is good.

In respects of retaining the rigidity and of achieving the weight saving, the porosity of the core layer and the skin layer ratio are preferably set so that the weight ratio (see Table 1) is equal to or less than 92%, more preferably set so that the weight ratio is equal to or less than 89%, and still more preferably set so that the weight ratio is equal to or less than 86%.

As these results show, the advantages of the present invention are apparent.

The head described above can be applied to all golf club heads.

The description hereinabove is merely for an illustrative example, and various modifications can be made in the scope not to depart from the principles of the present invention.

What is claimed is:

1. A golf club head comprising: a face; a crown; a sole; and a side, wherein at least a part of the crown, at least a part of the sole, or at least a part of the side is a porous portion including a porous metal;

the porous portion has skin layers formed on both sides thereof and a core layer formed between the skin layers, with the porosity of the skin layer being smaller than the porosity of the core layer; and porosity of a surface portion of the porous portion is smaller than porosity of an inner portion of the porous portion.

2. The golf club head according to claim 1, wherein a thickness of the skin layer is 0.05 mm or greater and 0.2 mm or less.

3. The golf club head according to claim 1, wherein the whole porous portion is integrally formed.

4. The golf club head according to claim 1, wherein the porous portion forms at least a part of the crown or at least a part of the side.

5. The golf club head according to claim 1, wherein a head volume is equal to or greater than 100 cc;

a head weight is equal to or less than 250 g; and a lateral moment of inertia of the head is equal to or greater than 2000 $g \cdot cm^2$.

6. The golf club head according to claim 1, wherein a head volume is equal to or greater than 400 cc;

a head weight is equal to or less than 200 g; and a lateral moment of inertia of the head is equal to or greater than 5000 $g \cdot cm^2$.

7. The golf club head according to claim 1, wherein the golf club head includes the porous portion and a non-porous portion; and the porous portion is welded to the non-porous portion.

8. The golf club head according to claim 1, wherein the porosity of the skin layer is equal to or less than 5%; and the porosity of the core layer is equal to or greater than 25%.

9. The golf club head according to claim 1, wherein a thickness t1 of the skin layer is smaller than a thickness t2 of the core layer.

10. The golf club head according to claim 1, wherein when a ratio of a thickness of the skin layer to the whole thickness of the porous portion is defined as a skin layer ratio, the skin layer ratio is 8% or greater and 80% or less.

11. The golf club head according to claim 1, wherein said porous portion is formed from a porous metal selected from the group consisting of titanium alloys, aluminum alloys, magnesium alloys, stainless steel, and maraging steel.

* * * * *